United States Patent [19]

Warehime

[11] 4,346,884

[45] Aug. 31, 1982

[54] MULTI-TEAM TUG-OF-WAR GAME APPARATUS

[76] Inventor: Norwood R. Warehime, 704 W. 34th St., Baltimore, Md. 21211

[21] Appl. No.: 191,085

[22] Filed: Sep. 26, 1980

[51] Int. Cl.[3] ..... A63B 21/28

[52] U.S. Cl. ..... 273/1 GH

[58] Field of Search ..... 273/1 GH, 1 GC; 272/116 A

[56] References Cited

U.S. PATENT DOCUMENTS

| | | | |
|---|---|---|---|
| 1,782,254 | 11/1930 | Breidenbach | 273/1 GH |
| 3,718,329 | 2/1973 | Sabo | 273/1 GH |
| 3,747,929 | 7/1973 | Burke . | |
| 4,153,245 | 5/1979 | McCoy . | |

OTHER PUBLICATIONS

*Strength & Health* 11-1979, pp. 39-45.

Cran Barry, Inc. of Marblehead Mass. USA, 1980 Catalog p. 32 Isotonic Pull Rope Item No. 597cBE.

*Primary Examiner*—Paul E. Shapiro

[57] ABSTRACT

Multi-team tug-of-war game apparatus for two to six teams of one to twelve players per team, with tugging ropes attached to central hub assembly, with appropriate radial orientation on angles of rope. Team players pull ropes in such a manner so as to try to topple their respective goal pieces set a short distance out from game area center. Central hub assembly has a vertically adjustable center pointer rod with central goal contactor attached to it below. Movement of contactor via movement of ropes can topple goal piece for game win. A graphic chart or mat is placed on playing surface to indicate game area center, angles of rope attachment, and location of goal pieces, with the latter two features depending on number of competing teams. In general, novel game permits very large groups, as well as small groups, to play a precision tug-of-war game readily, safely, and inexpensively as measured on a per person basis.

8 Claims, 4 Drawing Figures

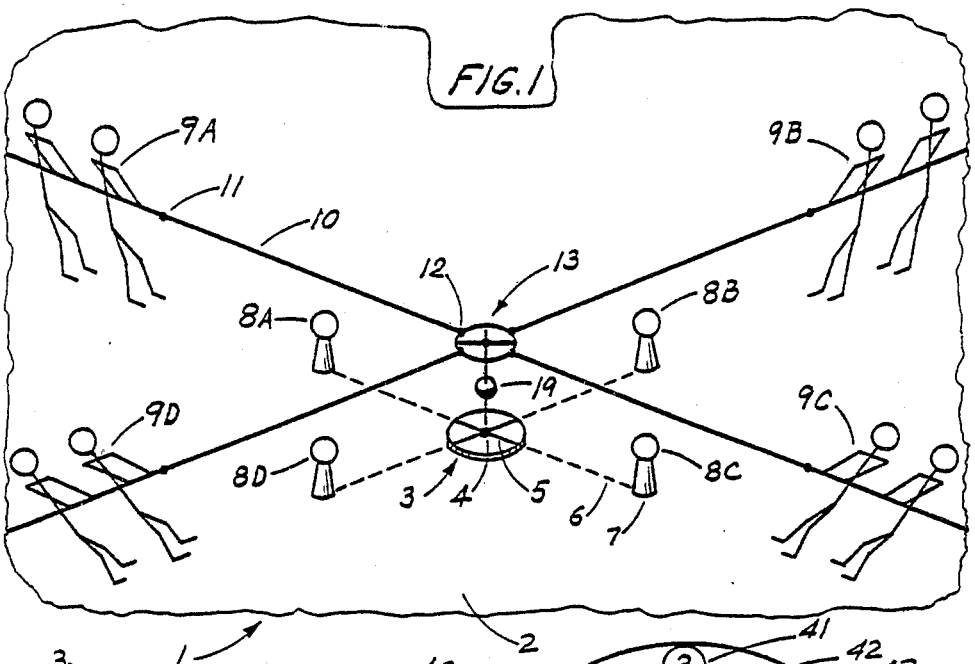
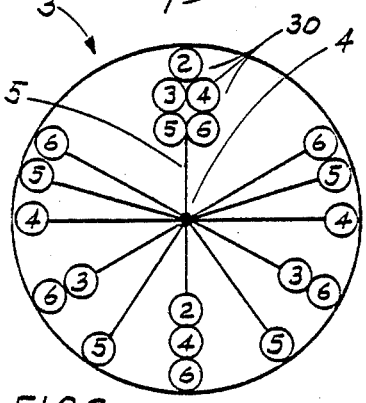
FIG. 2
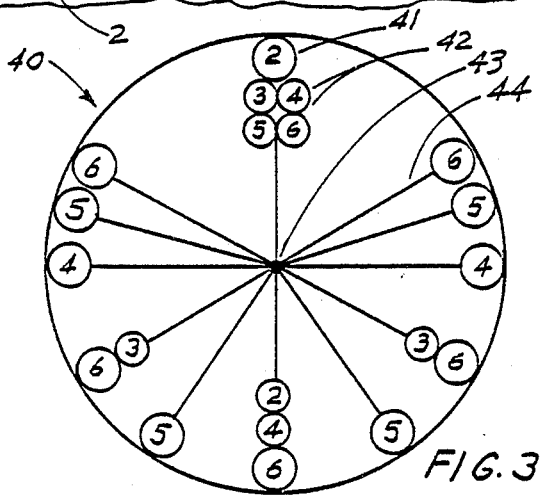
FIG. 3
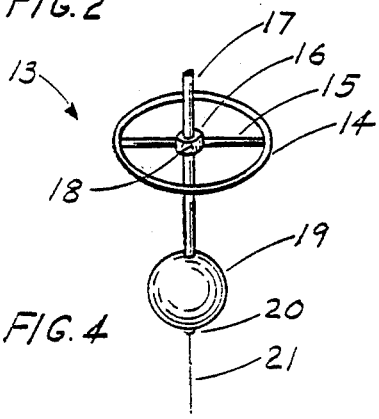
FIG. 4

MULTI-TEAM TUG-OF-WAR GAME APPARATUS

DESCRIPTION

1. Technical Field

The invention relates to a multi-team tug-of-war game apparatus; two to six teams of from one to twelve players per team, using tugging ropes attached to a central hub, with appropriate radial orientation of ropes, pull ropes in such a manner so as to topple respective goal pieces appropriately positioned a short distance out from central hub for game win.

2. Background Art

Many forms of tug-of-war games appear in prior art. Most forms are limited to two teams and use a simple central indicator such as a ribbon attached to overall center point of tugging rope, and goal lines positioned out from game area center point are used to determine game winner in competition. Flag devices actuated by movement of knots in tugging rope are also used in prior art to determine winner. Tug-of-war games using three or more team ropes are less common and have limited or no means for readily determining game winner in competition. A typical example of this latter tug-of-war set-up is shown on 1980 catalogue, page 32 of Cran Barry, Inc. of Marblehead, Mass., United States, Four team ropes are connected in such a manner so as to form a large square or diamond pattern where ropes interconnect. No exact starting and finishing points for winner determination are indicated if set-up is used in competition. Rope angles are not defined, and no readily means is indicated for changing number of ropes for use by more or less teams than the four team ropes shown.

U.S. Pat. No. 3,747,929 discloses an advance in use of defining reference marks for a four-way type rope movement game as shown in drawings. Game apparatus uses a central swinging striker to knock down goal pieces for various point scores in competition. Cited game is not actually a tug-of-war game since ropes are tied around participant's waists and same team players face each other on opposite sides of the central point of game area. Game play stresses cooperative team movement of ropes by body motion to cause centrally attached striker to knock down opponent's goal pieces set in a prescribed manner a short distance out from central point of game area. Total number of participants is limited to relatively few as compared to that of present invention.

U.S. Pat. No. 4,153,245 discloses a multi-team physical skill game using hand help ropes with participants standing in prescribed areas or on small portable platforms whereby participants try to unbalance opponents from their respective areas or platforms by rope movement for game win. Again, this game is not actually a tug-of-war game since game play stresses individual physical coordination, balance, and skill instead of muscle power and brute force. Furthermore, no center point of game area is indicated, and no center striker or contactor means is used to topple game goal pieces for determination of winner. Total number of participants is limited to relatively few as compared to that of present invention.

DISCLOSURE OF INVENTION

The invention as claimed is intended to provide a precision type of tug-of-war game apparatus suitable for group usage, with good flexibility as to number of teams and players participating. Game apparatus is simple, and can readily be set-up in an exact manner, with winner determination also made in an exact manner, even with as many as six teams participating in game play. A central hub ring, with a goal contactor below, is used to hold tugging ropes which radiate outwardly at proper angles as indicated on a graphic chart or mat disposed at center of playing area. Goal pieces, one for each team, are also positioned with reference to same chart or mat. Team tugging their rope far enough and in proper direction can knock down their goal piece and become game winner. If no goal piece is knocked down in a given period of time, the winner can be determined by exact measurement from a hub ring center pointer to closest goal piece.

The advantages offered by the invention are mainly that the central hub ring is designed to: (a) readily receive all tugging ropes via quick acting spring hook fasteners; (b) support central vertically adjustable dependent pointer rod; (c) support a goal contactor attached to lower end of pointer rod; and (d) support a fine linked chain type of precision pointer attached bottom of goal contactor. An accompanying graphic chart or mat used in game set-up at center of game area provides instant orientation for attaching team ropes, centering of the hub ring, and positioning of the team goal pieces. The goal pieces can be simple game cones with inexpensive play balls resting loosely on top of them. In general, novel game permits very large groups, as well as small groups, to play a precision tug-of-war game readily, safely, and inexpensively as measured on a per person basis.

BRIEF DESCRIPTION OF DRAWINGS

Drawings used in the description of the invention are as follows:

FIG. 1 is an upper angle schematic view showing game apparatus and player positioning;

FIG. 2 is a plan view of a relatively small graphic chart used for game apparatus positioning, showing game area center and angles for rope attachment to central hub and angles for placement of goal pieces, depending on number of competing teams;

FIG. 3 is a plan view of a relatively large graphic mat type chart used for game apparatus positioning, showing game area center, angles for rope attachment to central hub, and exact positions for placement of goal pieces, with the latter two features depending on number of competing teams.

FIG. 4 is an enlarged upper angle view showing central hub, pendant goal contactor attached to hub via support member, and fine chain precision pointer.

DESCRIPTION AND PREFERRED EMBODIMENT FOR CARRYING OUT INVENTION

FIG. 1 of drawings shows a schematic view of preferred embodiment of invention wherein playing area is generally indicated by numeral 1, and playing surface is indicated by 2. Game area size and surface feature requirements are consistent with those generally used for tug-a-war and group recreational activities. For maximum area size required, figuring 12 players spaced along each rope at one yard (one meter), and with three or more teams competing, a circular area of about 30 yards (30 meters) in diameter would be required. Apparatus position indicator chart is generally indicated by numeral 3. This circular chart 3 is about 15 inches (38.1 cms) in diameter, is made of rigid plastic or stiff cloth, and has graphic lines and circles on it to indicate certain apparatus positions and rope angles. On chart 3, the black circle 4 in center is used to indicate center of game area. The line 5 on chart 3 is typical of the four lines radiating outwardly from chart center 4. Since the example game shown herein has four teams, the logical team rope spacing is at 90° between ropes. So rope angle indication lines on chart 3 are indicated by number "4" in small circles as shown on chart detail in FIG. 2. Other rope angles for various numbers of competing teams are determined from lines and circled numbers on chart 3 in a similar manner. With chart 3 in place on playing surface 2, placement of goal cones represented by numeral 7 can be made at a set distance out from chart center 4. A typical set distance is one yard (one meter). With four teams competing, the four cones are set on projection of the same rope lines on chart 3, with projection lines indicated by 6. The four goal balls 8A, 8B, 8C, and 8D are placed on their respective cones as shown. The cones 7 made of plastic, are about 12 inches (30.5 cms) high, and the balls are about eight inches (20.3 cms) in diameter and are lightweight rubber or plastic.

With chart 3 and the four goal pieces in proper places, team players represented by team leaders 9A, 9B, 9C, and 9D, attach their ropes 10 to hub ring 14 of central rope attachment hub assembly generally indicated by numeral 13 by use of quick acting spring hook fasteners indicated by 12. Team players next hold ropes in air at waist height and make rope system taut for hub center alignment with game area center 4 on chart 3 on playing surface 2. Players must grasp rope no closer to hub than the limit mark or knot on rope indicated by 11. Referring to hub assembly, a pointer rod 17 is passed through hub eye 16 attached to hub ring 14 by spoke arms 15. Rod 17 can be adjusted vertically by means of set-screw 18 in hub eye 16. Goal contactor 19, in the form of a rigid ball about 5 inches (12.7 cms) in diameter, is fastened to lower end of rod 17, and a vertically adjustable fine linked chain 21 used as a precision center pointer is attached to bottom of goal contactor ball 19 via hook 20.

FIG. 2 is a detail of apparatus positioning indicator graphic chart generally indicated by numeral 3 and is about 15 inches (38.1 cms) in diameter. Black chart center is 4, and rope and goal piece orientation lines radiating outwardly from 4 are generally represented by 5. Circled numbers on chart indicated generally by 30 are the number of competing teams which determine the number of ropes used, the angles for rope attachment, and the angles for goal piece placement. With example game described above, the four ropes are attached to hub ring at 90° spacing. Chart shows the number "4" encircled at four locations at the 90° spacing. Other team numbers ranging from 2 to 6 are similarly represented on chart by circled numbers and orientation lines. FIG. 3 is a detail of apparatus positioning indicator graphic mat generally indicated by numeral 40 and is about 2.5 yards (2.5 mts) in diameter. This graphic mat is an enlargement of the graphic chart shown in FIG. 2, but it has one added feature. The larger perimeter circles represented by 41 on mat also are used for exact goal piece positioning markers. Rope numbers represented by 42, rope orientation lines represented by 44, and mat chart center 43 are used similarly as described for chart 3 in FIG. 2. The main advantage of mat 40 over chart 3 is that the former has exact goal piece placement markers on it, whereas latter requires measurement of set distance out from chart center 4 along projections 6 from orientation lines 5 on chart. This advantage must be weighed against a more costly and bulky mat. FIG. 4 is a detail of central rope attachment hub assembly generally indicated by numeral 13, consisting of hub ring 14 with spoke arms 15 having a central hub eye 16 with a pointer and support rod 17 passing through eye 16. Rod 17 is vertically adjustable by means of set-screw 18 in hub eye 16. Goal contactor 19, in form of a rigid ball, is fastened to lower end of rod 17, and a vertically adjustable fine linked chain 21, used as a precision center pointer, is attached to bottom of goal contactor ball 19 via hook 20 in bottom of ball.

For competition, players and apparatus can be readied in a few minutes. With the assistance of a referee, teams line up as required and center hub ring is maneuvered into a position above game area center mark on chart or mat. The referee guides teams for exact alignment of fine pointer chain marker and chart center mark. When alignment is made and rope angles radiating outwardly from hub ring are approximately in position, the referee can give signal for teams to start pulling their ropes. Team that pulls their rope far enough back in proper direction to topple their goal piece is declared winner. If no team is able to topple their goal piece after a time limit, the team with goal piece closest to fine pointer chain marker attached to hub ring is declared winner. During competition, players can not encroach beyond limit mark 11 on rope, can not touch goal pieces, can not cause their rope to touch goal pieces, and can not touch other team players or ropes. If team commits a foul, the team can be disqualified, or can be penalized by setting back their goal piece a certain distance from chart or mat center. A false start at begining of competition can also be considered a foul with resulting penalty.

The invention may be embodied in other specific forms without departing from spirit or essential attributes thereof and, accordingly, reference should be made to the attached claims, rather than the forgoing description as indicating the scope of the invention.

I claim:

1. Multi-team tug-of-war game apparatus comprising a playing surface, said playing surface including a game area, a plurality of tugging ropes, a central hub including a vertically dependent position indicating pointer, means for attaching one end of each of said ropes to said central hub, a game apparatus positioning indicator means for indicating the starting position of said pointer over said game area, and for indicating the proper relative radial orientation of said ropes relative to said hub, a plurality of goals on said playing surface positioned about and spaced from said starting position, and a goal contactor means on said pointer for contacting said goals to indicate the winner of a tug-of-war contest whereby a plurality of ropes equal in number to the number of teams using the apparatus may be attached to said hub at proper positions and relative radial orientation, said hub may be positioned centrally relative to said goal means, and team players may pull their respective ropes in an attempt to cause said goal contactor means to contact their assigned goal to win tug-of-war contest.

2. Multi-team tug-of-war game apparatus according to claim 1 wherein said apparatus positioning indicator means comprises a graphic chart which is normally disposed horizontally on said playing surface with a center mark on said chart to indicate center of playing area and with said chart also having a plurality of directional lines to indicate the proper radial orientation for attaching said ropes to said hub and to indicate alignment for placement of said goals, there being different sets of lines for different numbers of teams.

3. Multi-team tug-of-war game apparatus according to claim 1 wherein said apparatus positioning indicator means comprises a graphic mat which is normally disposed horizontally on said playing surface with a center mark on said mat to indicate center of playing area and with said mat also having a plurality of directional lines to indicate the proper radial orientation for attaching said ropes to said hub and having a plurality of markers to indicate exact positions for placement of said goals, there being different sets of lines for different numbers of teams.

4. Multi-team tug-of-war game apparatus according to claim 1 wherein said central hub comprises a metal ring to accommodate the attachment of a plurality of said tugging ropes and with said ring to have a cross support member placed thereon so said pointer be located at center of said hub.

5. Multi-team tug-of-war game apparatus according to claim 4 wherein said pointer comprises a vertically adjustable rod with upper end of said rod passing centrally through an opening in said cross support member of said ring and with lower end of said rod supporting said goal contactor.

6. Multi-team tug-of-war game apparatus according to claim 5 wherein projection of lower end of said pointer below said goal contactor comprises a vertically adjustable length of fine linked chain centrally attached to lower extremity of said goal contact.

7. Multi-team tug-of-war game apparatus according to claim 1 wherein said goal contactor comprises a rigid sphere.

8. Multi-team tug-of-war game apparatus according to claim 1 wherein said goals comprise play balls normally resting loosely on game cones.

* * * * *